US008678551B2

(12) United States Patent
Yoshida

(10) Patent No.: US 8,678,551 B2
(45) Date of Patent: Mar. 25, 2014

(54) PRINTING APPARATUS AND PRINTING METHOD

(75) Inventor: Seishin Yoshida, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 13/223,058

(22) Filed: Aug. 31, 2011

(65) Prior Publication Data

US 2012/0056922 A1 Mar. 8, 2012

(30) Foreign Application Priority Data

Sep. 2, 2010 (JP) ..... 2010-196598

(51) Int. Cl.
*B41J 2/14* (2006.01)
*B41J 2/16* (2006.01)

(52) U.S. Cl.
USPC ..... 347/43; 347/9; 347/95; 347/100

(58) Field of Classification Search
USPC ..... 347/6, 9, 20, 43, 95, 100, 101–107, 14, 347/19; 106/31.13, 31.6, 31.27; 523/160–161
See application file for complete search history.

(56) References Cited

U.S. PATENT DOCUMENTS

| | | | | |
|---|---|---|---|---|
| 5,521,002 | A * | 5/1996 | Sneed | 428/331 |
| 6,338,889 | B1 * | 1/2002 | Shibata et al. | 428/64.4 |
| 6,480,217 | B1 | 11/2002 | Inoue et al. | |
| 7,384,126 | B2 * | 6/2008 | Nakamura et al. | 347/40 |
| 7,407,277 | B2 | 8/2008 | Yoneyama | |
| 7,562,957 | B2 | 7/2009 | Mills et al. | |
| 7,798,602 | B2 | 9/2010 | Kobayashi et al. | |

FOREIGN PATENT DOCUMENTS

| | | |
|---|---|---|
| JP | 2001-001560 A | 1/2001 |
| JP | 2007-050555 A | 3/2007 |

* cited by examiner

*Primary Examiner* — Juanita D Jackson
(74) *Attorney, Agent, or Firm* — Maschoff Brennan

(57) ABSTRACT

A printing apparatus includes a print head that is able to apply light-blocking ink that blocks light and metallic ink that creates a metallic look on a printing medium, a metallic look control unit that determines the ink amount per unit area of the light-blocking ink that the print head applies based on the created metallic look, and an ink application control unit that controls the print head, applies the metallic ink and the light-blocking ink based on the determined ink amount on the printing medium, and laminates the metallic ink and the light-blocking ink such that the side that is viewed has the metallic ink.

8 Claims, 10 Drawing Sheets

FIRST PRINTING MODE
(PRINTING MEDIUM: LIGHT-TRANSMITTING PRINTING MEDIUM)

SECOND PRINTING MODE
(PRINTING MEDIUM: LIGHT-TRANSMITTING PRINTING MEDIUM)

COLOR COLORING REGION

METALLIC REGION

WHITE REGION

FIRST PRINTING MODE
(PRINTING MEDIUM: LIGHT-TRANSMITTING PRINTING MEDIUM)

SECOND PRINTING MODE
(PRINTING MEDIUM: LIGHT-TRANSMITTING PRINTING MEDIUM)

THIRD PRINTING MODE
(PRINTING MEDIUM: NON-LIGHT-TRANSMITTING PRINTING MEDIUM)

FIRST AND THIRD PRINTING MODES

SECOND PRINTING MODE

PRINTING APPARATUS AND PRINTING METHOD

Priority is claimed under 35 U.S.C. §119 to Japanese Application No. 2010-196598 filed on Sep. 2, 2010 which is hereby incorporated by reference in its entirety.

BACKGROUND

1. Technical Field

The present invention relates to a printing apparatus, and more specifically, relates to a printing apparatus that is able to apply light-blocking ink and metallic ink on a printing medium.

2. Related Art

In recent years, printing apparatuses, particularly printing techniques such as printers that print image data that is processed by a computer have been showing signs of diversifying beyond the confines of mere color printing. A printing technique using metallic ink is one such example. For example, a technique of forming a light-blocking layer for performing printing on a transparent printing medium (JP-A-2001-001560), a technique of dividing nozzle rows that are included on a print head of a printing apparatus into a first half and a second half, printing metallic ink with the first half portions of the nozzle rows as a ground color layer, and printing a color image with the second half portions of the nozzle rows (JP-A-2007-50555), and the like are known.

However, with a printing apparatus of the related art, in a case when a metallic look is imparted to a print image by metallic ink, it was difficult to control the degree of the metallic look. Problems have been identified in which in a case when the metallic look is controlled by the dot recording rate of the metallic ink that is applied on a printing medium, if the dot recording rate of the metallic ink is lowered in order to tone down the metallic look, the granularity stands out such that the dots of the metallic ink become observable, and further, in a case when the printing medium is light-transmissive, the light transmissivity of the print image increases and the opacity decreases.

SUMMARY

An advantage of some aspects of the invention is that a technique of easily controlling the metallic look in printing using metallic ink is provided.

In order to solve at least a portion of the problems described above, aspects of the invention are able to adopt the following embodiments or applied examples.

APPLIED EXAMPLE 1

A printing apparatus includes a print head that is able to apply light-blocking ink that blocks light and metallic ink that creates a metallic look on a printing medium, a metallic look control unit that determines the ink amount per unit area of the light-blocking ink that the print head applies based on the created metallic look, and an ink application control unit that controls the print head, applies the metallic ink and the light-blocking ink based on the determined ink amount on the printing medium, and laminates the metallic ink and the light-blocking ink such that the side that is viewed has the metallic ink.

By such a printing apparatus, the metallic look of a print image is controlled by controlling the ink amount per unit area of the light-blocking ink that is applied on a printing medium. This is based on the knowledge that, in a case when the metallic ink and the light-blocking ink are applied on a printing medium such that the side that is viewed has the metallic ink, the metallic look that is created is changed by changing the ink amount of the light-blocking ink. Therefore, the printing apparatus is able to tone down the metallic look of a print image without reducing the ink amount per unit area of the metallic ink to an extent that the granularity of the metallic ink stands out.

The metallic ink according to an aspect of the invention contains a metallic pigment that creates a metallic look after being affixed on the surface of a printing medium. The metallic ink is an ink that has metallic luster, and the metallic luster is created by the metallic pigment contained in the metallic ink. A metallic pigment that has been dispersed in an appropriate solvent, for example, an aqueous solvent or an oil-based solvent, is able to be used as the metallic ink. The latter is an oil-based ink composition in which an organic solvent and a resin are used as the solvent. In order to cause metallic luster to be produced effectively, the metallic pigment described above preferably has plate-shaped particles, and in a case when the longitudinal dimension of a plate-shaped particle on the plane thereof is X, the lateral dimension is Y, and the thickness is Z, the 50% average particle diameter R50 of the circular equivalent diameter calculated by the area of the X-Y plane of the plate-shaped particle is 0.5 to 3 μm, and preferably satisfies the condition R50/Z>5. Such a metallic pigment may, for example, be formed by aluminum or an aluminum alloy, and, further, is able to be formed by crushing a metallic deposited membrane. The density of the metallic pigment contained in the metallic ink may, for example, be 0.1 to 10.0 mass %. Of course, the metallic ink is not limited to such a composition, and other compositions may be appropriately adopted as long as metallic luster is able to be produced.

Furthermore, the metallic look of the metallic ink is described below from the point of view of optical characteristics. Since the metallic look is a sense of viewing reflected light, various indicators that represent the metallic look by being dependent on the reflection angle of the optical characteristics have been proposed. Therefore, it is possible to regulate the metallic ink that creates the metallic look using such indicators. For example, a known metallic look indicator value In1 expressed in the Equation 1 below may be used. The metallic look indicator value In1 measures the brightness of the reflected light at three different locations that are regulated by Equation 1 when a measurement target (metallic look created printed material) is irradiated from an angle of −45°, and is able to be determined from the relationship between the brightness obtained from the three locations. Therefore, with the metallic look indicator value In1, the metallic ink is able to be regulated by making the metallic ink the same as the metallic pigment for creating the metallic look described above.

Equation 1

$$In1 = \frac{2.69(L_1^* - L_3^*)^{1.11}}{L_2^{*0.86}} \quad (1)$$

$L_1$*: Brightness at a light-receiving angle of 30° (irradiation angle) −45°

$L_2$*: Brightness at a light-receiving angle of 0° (irradiation angle) −45°

$L_3$*: Brightness at a light-receiving angle of −65° (irradiation angle) −45°

Otherwise, a metallic look indicator value In2 that is expressed by Equation 2 below or a metallic look indicator value In3 that is expressed by Equation 3 below using the brightness of the three locations in regulating the metallic look indicator value In1 may be used as the indicator of the metallic look.

Equation 2

$$In2 = \frac{3(L_1^* - L_3^*)}{L_2^*} \quad (2)$$

Equation 3

$$In3 = L_1^* - L_3^* \quad (3)$$

Since all of the indicator values shown in the equations above are fixed as values that are dependent on the reflection angles, a unique luster ink is able to be regulated by the indicator values.

APPLIED EXAMPLE 2

The printing apparatus according to Applied Example 1, wherein the metallic look control unit further determines the ink amount per unit area of the metallic ink that is applied by the print head depending on the metallic look to be created.

According to such a printing apparatus, control of the metallic look that is created by controlling the ink amount per unit area of the metallic ink as well as of the ink amount per unit area of the light-blocking ink is able to be performed. Since the feel of the metallic look that the user sees differs between a case when the ink amount of the light-blocking ink is controlled and a case when the ink amount of the metallic ink is controlled, by combining the increase or decrease in the ink amount of the light-blocking ink and the increase or decrease in the ink amount of the metallic ink, a wide range of feel of the metallic look is able to be expressed.

APPLIED EXAMPLE 3

The printing apparatus according to Applied Example 1 or Applied Example 2, wherein the printing medium is a light-transmissive printing medium with light transmissivity.

According to the printing apparatus, printing on a light-transmissive printing medium is possible. Therefore, printing in a case when a print image is viewed from a printing surface or printing in a case when the print image is viewed from the opposite side to the printing surface becomes possible.

APPLIED EXAMPLE 4

The printing apparatus according to any of Applied Example 1 to Applied Example 3, wherein the light-blocking ink is white ink.

According to the printing apparatus, since white ink is used as the light-blocking ink, the brightness of the print image is able to be secured.

APPLIED EXAMPLE 5

The printing apparatus according to any of Applied Example 1 to Applied Example 4 including a main scanner that relatively moves the print head along the width direction of the printing medium, wherein the print head includes a plurality of nozzles arranged for each of the inks which eject each of the inks in a direction that intersects the movement direction, and the nozzles of each of the inks are arranged in the order of the light-blocking ink and the metallic ink from the front of the movement direction of the print head.

According to the printing apparatus, the light-blocking ink and the metallic ink are able to be applied on a printing medium in that order by ejecting the inks of each color while moving the print head in the movement direction.

APPLIED EXAMPLE 6

The printing apparatus according to any of Applied Example 1 to Applied Example 5, wherein the print head is further able to apply color ink on the printing medium.

According to the printing apparatus, it is possible to print a color print image.

APPLIED EXAMPLE 7

A printing method of performing printing using light-blocking ink that blocks light and metallic ink that creates a metallic look, including determining the ink amount per unit area of the light-blocking ink that is applied on a printing medium depending on the metallic look to be created, and applying the metallic ink and the light-blocking ink based on the determined ink amount on the printing medium and laminating the metallic ink and the light-blocking ink such that the side that is viewed has the metallic ink.

According to the printing method, the metallic look of a print image is controlled by controlling the ink amount per unit area of the light-blocking ink that is applied on the printing medium. Therefore, the printing apparatus is able to tone down the metallic look of a print image without reducing the ink amount per unit area of the metallic ink to such an extent that the granularity of the metallic ink stands out.

In addition, aspects of the invention are able to be realized by a variety of embodiments. For example, the aspects of the invention are able to be grasped by a program that realizes a printing control method by a computer or a recording medium in which the program is recorded.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, the embodiments of the invention will be described based on examples.

A. First Example

A1. System Configuration

Figure 1:
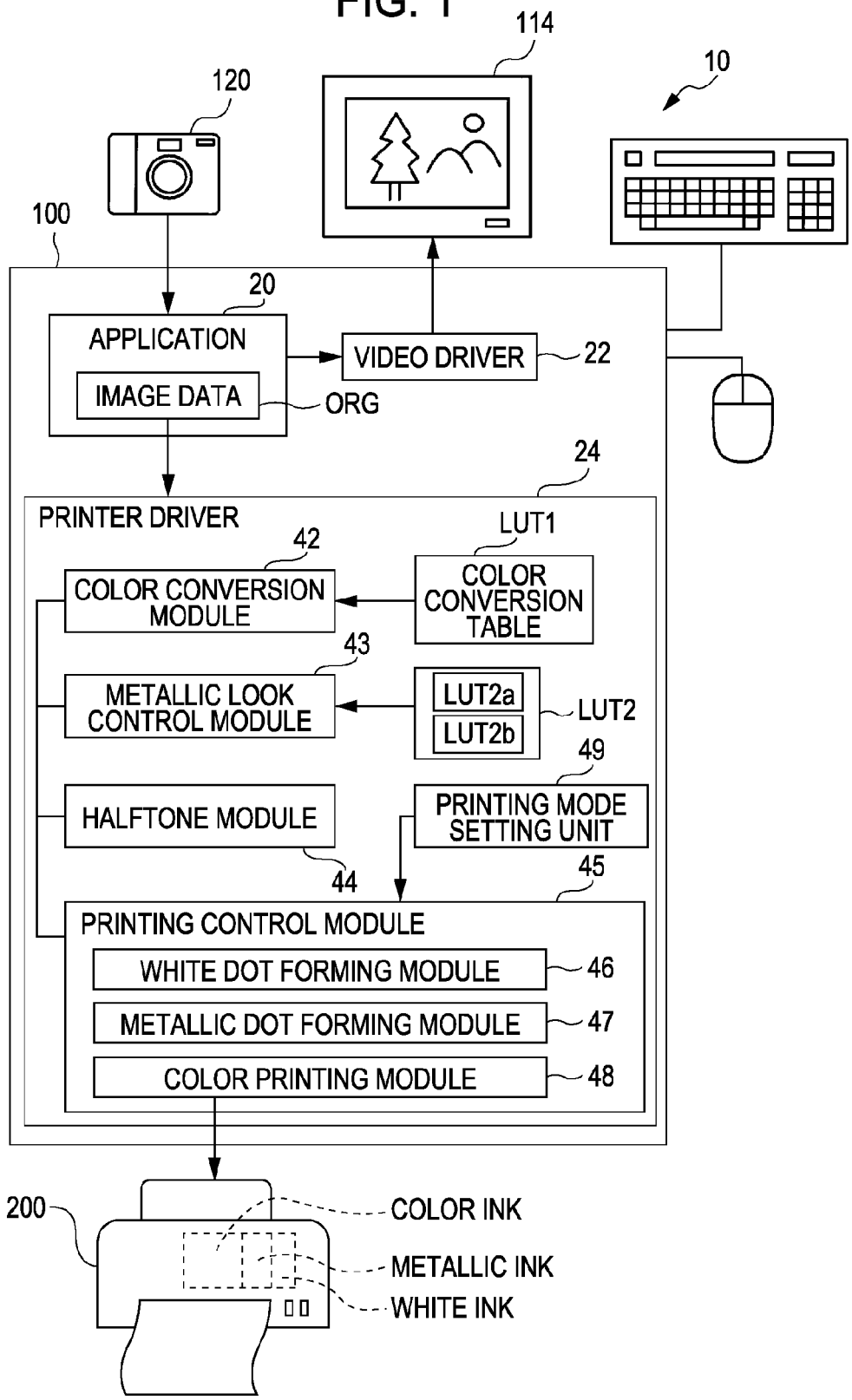
FIG. 1 is a configuration diagram that describes a configuration of a printing system.

FIG. 1 is an outline configuration diagram of a printing system 10 as an embodiment of the example. As illustrated in the drawing, the printing system 10 of the example is configured from a computer 100 as a printing control apparatus, a printer 200 that actually prints an image under the control of the computer 100, and the like. The printing system 10 functions as a printing apparatus of a broader application in which the entirety thereof is integrated.

Cyan ink (C), magenta ink (M), yellow ink (Y), and black ink (K) are included in the printer 200 of the example as color ink. Further, metallic ink (S) that exhibits metallic luster by a metallic pigment that is contained therein and white ink (W) that is used as light-blocking ink are included to be printable. Light-blocking ink is ink that blocks light. Although white ink (W) is used as the light-blocking ink in the example, other colors are also usable as long as the ink blocks light. For example, color ink that blocks light or pearlescent white is able to be used. Further, a semi-transparent color ink may be used as long as the ink blocks light. Here, in the specification, although "color ink" is used to also include black ink, the printer 200 may equally have a configuration in which black ink is not included. In such a case, the color black may be expressed by so-called composite black using each of the inks of cyan, magenta, and yellow.

In contrast to the printer 200, a configuration of the computer 100 that prepares and supplies data for printing will be described. A predetermined operating system is installed on the computer 100, and an application program 20 acts under the operating system. A video driver 22 or a printer driver 24 is built into the operating system. The application program 20 inputs image data ORG, for example, from a digital camera 120. Then, the application program 20 displays an image that is represented by the image data ORG via the video driver 22 on a display 114. In addition, the application program 20 outputs the image data ORG via the printer driver 24 to the printer 200.

Figures 2A, 2B, 2C:
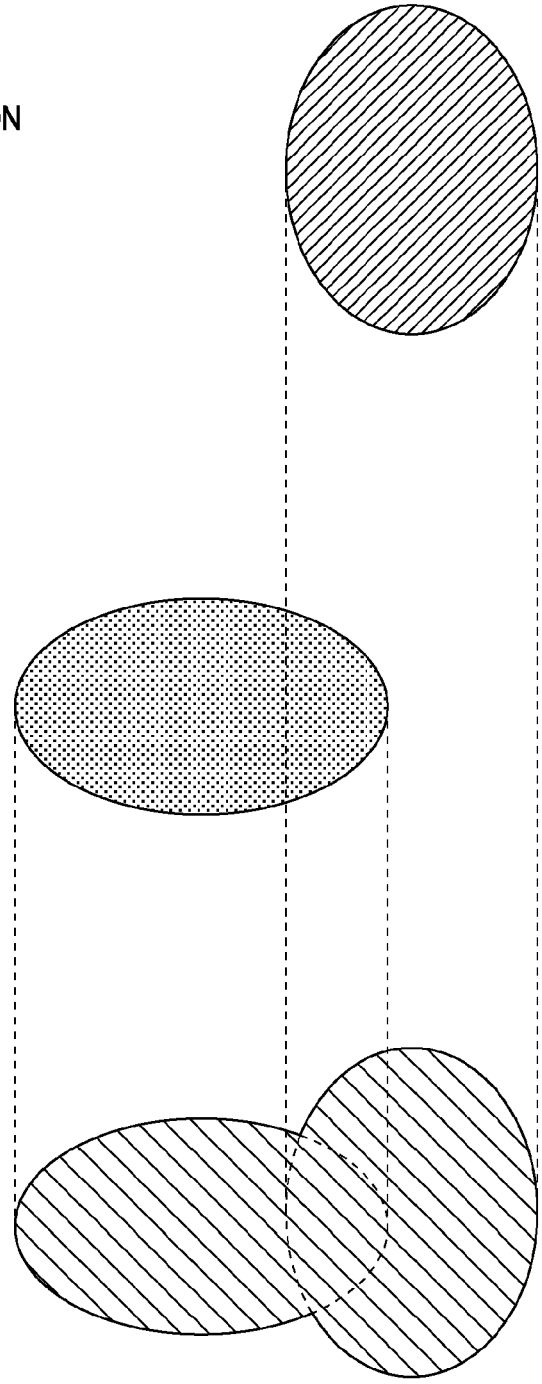
FIG. 2A is an explanatory diagram that describes a colored region.
FIG. 2B is an explanatory diagram that describes a metallic region.
FIG. 2C is an explanatory diagram that describes a white region.

In the example, the image data ORG that is input from the digital camera 120 is data that is composed of color components of the three colors of red (R), green (G), and blue (B). The application program 20 applies, according to need, data of white ink (W) and data of metallic ink (S) to the image data ORG that is input from the digital camera 120. That is, the application program 20 is able to designate a region composed of the color components of R, G, and B (hereinafter referred to as "colored region") and a region in which metallic ink is printed (hereinafter referred to as "metallic region"), and along with the designation of the colored region and the metallic region, automatically sets a region in which white ink is applied on the printing medium (hereinafter referred to as "white region"). FIGS. 2A to 2C are explanatory diagrams that illustrate each region. FIG. 2A illustrates a colored region, FIG. 2B illustrates a metallic region, and FIG. 2C illustrates a white region. The white region is set as the metallic region, the colored region, and a region in which the two regions overlap. In a region in which the metallic region and the colored region overlap, a color image is formed over a background color of the metallic luster produced by a metallic pigment of the metallic ink. That is, the overlapping region becomes a metallic color region. Further, the metallic region may only use metallic ink (exclusively metallic region). In a case when the metallic region is designated in such a manner, other than designating the regions in advance, for example, a printing region of a specified shape may be programmed to be the metallic region by the application program 20, or a printing region by a specified color may be programmed to be the metallic region by the application program 20.

As described above, although the white region is automatically set along with the designation of the colored region and the metallic region, the ink amount of the white ink that is applied to each region is different. The white region that corresponds to a region that does not overlap the metallic region out of the colored region (non-metallic region) has a fixed amount of the ink amount of the white ink that is applied. On the other hand, the ink amount of the white ink that is applied for a white region that corresponds to the metallic region to which the metallic ink is applied (exclusively metallic region and the metallic color region) changes by the metallic look that is designated by the application program 20. The metallic look is able to be designated by the user via the application program 20 using a predetermined indicator value that shows the degree of the metallic look (hereinafter also referred to as a metallic indicator value).

The printer driver 24 receives the image data ORG from the application program 20 and converts the image data ORG into data to be output to the printer 20. The printer driver 24 includes a color conversion module 42 that performs color conversion, a color conversion table LUT 1 that the color conversion module 42 references when color converting, a halftone module 44 that turns image data after color conversion into multiple values, a printing control module 45 that converts the data that has been turned into multiple values into dot data of the ink of each color, and a printing mode setting unit 49 that performs setting on the printing control module 45. The printing control module 45 includes a white dot forming module 46, a metallic dot forming module 47, and a color printing module 48 on the inside thereof. Furthermore, the printer driver 24 includes a metallic look control module 43 that controls the degree of the metallic look of the metallic region and a white ink amount table LUT 2*a* and a white ink amount table LUT 2*b* (hereinafter also referred to together simply as "white ink amount table LUT 2") that the metallic look control module 43 references when controlling the metallic look of the metallic region.

The color conversion module 42 receives the image data ORG from the application program 20, references the color conversion table LUT 1 that is prepared in advance based on each component data of R, G, and B (hereinafter referred to as RGB components) that is contained in the image data ORG, and converts the RGB components of the colored region in the image data ORG into color components (cyan (C), magenta (M), yellow (Y), and black (K)) that the printer 200 is able to express.

The halftone module 44 performs halftone processing that represents the gradations of the image data that is color converted by the color conversion module 42 as a distribution of dots. In the example, a commonly known systematic dither method is used as the halftone processing. Here, other than the systematic dither method, other halftone techniques such as an error diffusion method or a density pattern method are able to be used as the halftone processing.

The metallic look control module 43 determines the ink amount of the white ink to be applied based on the white region that corresponds to the metallic region that the user designates via the application program 20 and the metallic indicator value that is equivalent to the gradation of the metallic look. Once the image data ORG is received from the application program 20, the metallic look control module 43 references the white ink amount table LUT 2 prepared in advance based on information relating to the metallic region of the image ORG, that is, the position of the metallic region and the metallic indicator value that is designated for each metallic region, and determines the dot recording rate (ink duty) of the white ink per unit area which is applied to the white region that corresponds to the metallic region. Hereinafter, the dot recording rate of the white ink is referred to as ink duty WD.

The printing control module 45 uses the halftone processed data and the ink duty WD that is determined by the metallic look control module 43 to convert into a signal to instruct the printer 200 to form the dots of each ink. The color printing module 48 performs dot formation using the color ink of each of the colors described above on the halftone processed image, that is, the image of the colored region. The metallic dot formation module 47 forms dots of metallic ink (metallic ink) of a predetermined size on the metallic region that is designated by the application program 20.

The white dot formation module 46 forms white dots on a region that overlaps the metallic region and the colored region, that is, the white region. Out of the white region in which white dots are formed, the ink duty WD of the non-metallic region is set in the white dot forming module 46 in advance as a fixed value, and the white dots are formed based on such a fixed value. On the other hand, out of the white region, with regard to a region that overlaps the metallic region, the white dot forming module 46 forms white dots based on the ink duty WD that is determined by the metallic look control module 43.

Figure 3A:
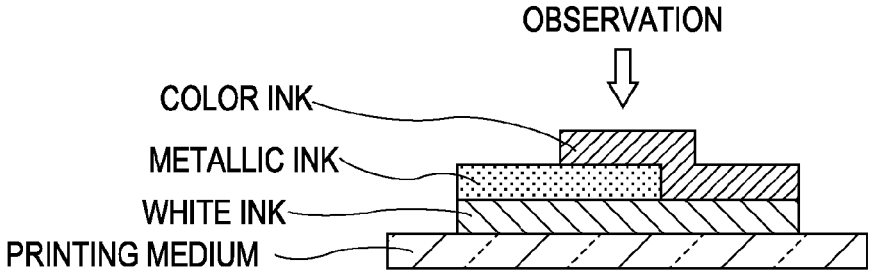
FIG. 3A is an explanatory diagram that describes a first printing mode.
Figure 3B:
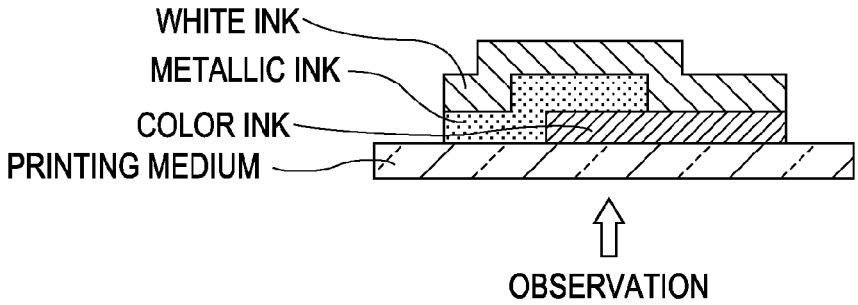
FIG. 3B is an explanatory diagram that describes a second printing mode.
Figure 3C:
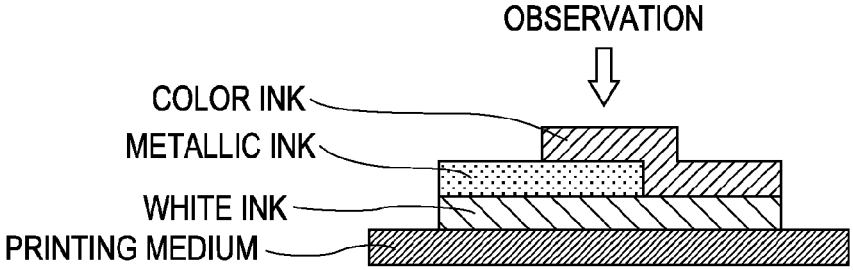
FIG. 3C is an explanatory diagram that describes a third printing mode.

The printing mode setting unit 49 receives an instruction from the user as to which printing mode out of the first to third printing modes is to be executed before starting the printing process, and sets the printing mode based on the received instruction. Here, the printing mode will be described. FIGS. 3A to 3C are explanatory diagrams that describe the first to third printing modes. FIG. 3A schematically illustrates a cross-sectional diagram of a printing medium after printing in a case when printing is performed by the first printing mode. The first printing mode is a printing mode that uses a light-transmissive printing medium with light transmissivity as the printing medium and which is used in a case when the print image is observed from the printing surface. With the first printing mode, the white ink is applied first as the light-transmissive ink on the light-transmissive printing medium. The white ink is applied on the white region, that is, the colored region, the metallic region, and a region in which the two regions overlap. Next, the metallic ink is applied on the metallic region. Further, finally, the ink of each color (C, M, Y, and K) is applied on the color region.

FIG. 3B schematically illustrates a cross-sectional diagram of a printing medium after printing in a case when printing is performed by the second printing method. The second printing mode is a printing mode that uses a light-transmissive printing medium with light transmissivity as the printing medium and which is used in a case when the print image is observed from the opposite side to the printing surface. With the second printing mode, the color ink is applied first in the color region on the light-transmissive printing medium. Next, the metallic ink is applied on the metallic region. Further, finally, the white ink is applied.

FIG. 3C schematically illustrates a cross-sectional diagram of a printing medium after printing in a case when printing is performed by the third printing mode. The third printing mode is a printing mode that uses a light-transmissive printing medium, for example, a paper medium or a printing medium composed of a non-light-transmissive plastic, as the printing medium and which is used in a case when the print image is observed from the printing surface. With the third printing mode, the order in which the ink is applied on the printing medium is the same as in the first printing mode. That is, the white ink is applied first as the light-blocking ink on the non-light-transmissive printing medium. Next, the metallic ink is applied on the metallic region. Further, finally, the color of each ink (C, M, Y, and K) is applied on the color region.

Figure 4:
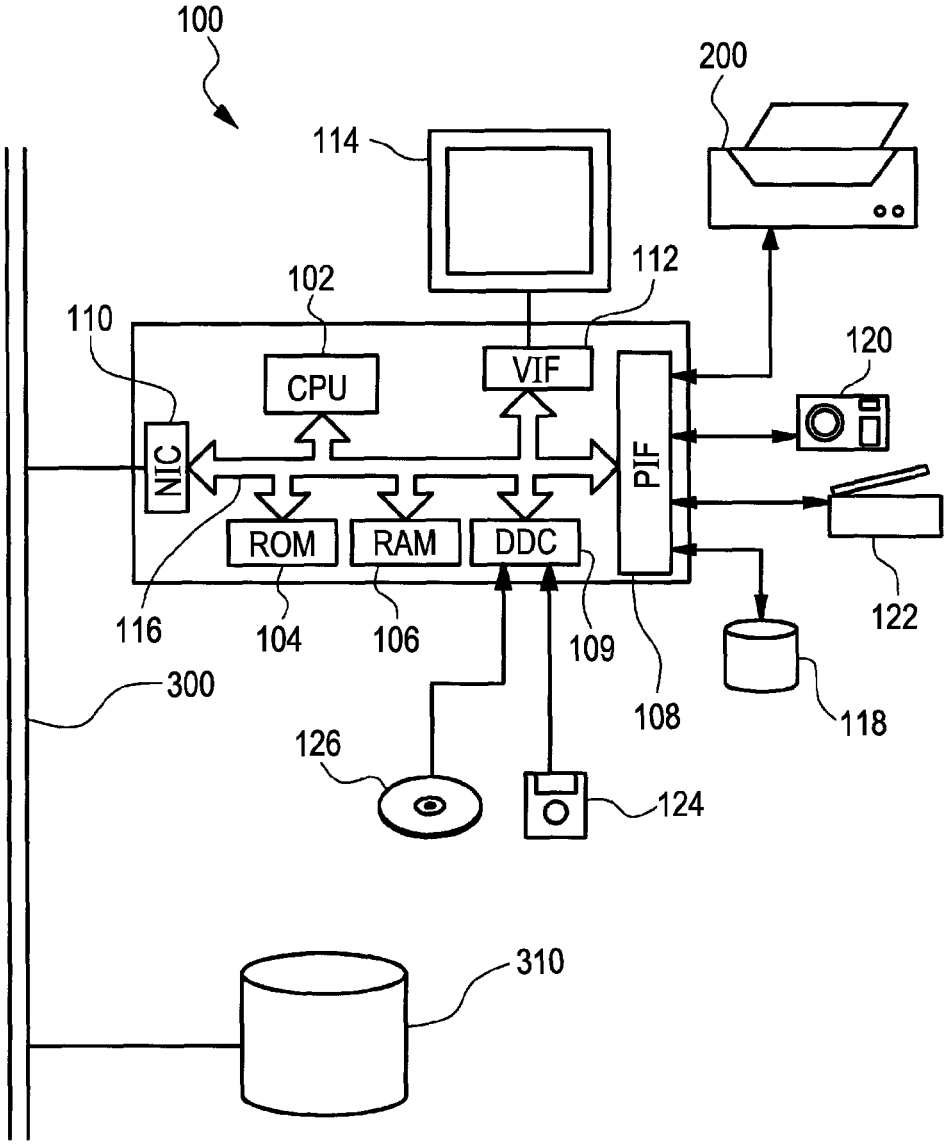
FIG. 4 is an explanatory diagram that describes a configuration of a computer.

Next, a specific configuration of the computer 100 as a printing control apparatus will be described. FIG. 4 is a conceptual configuration diagram of the computer 100. The computer 100 has a commonly known configuration of connecting a ROM 104, a RAM 106, and the like around a CPU 102 with one other by a bus 116.

A disk controller 109 for reading data from a flexible disk 124, a compact disc 126, or the like, a peripheral interface 108 for transmitting and receiving data with peripherals, and a video interface 112 for driving the display 114 are connected to the computer 100. The printer 200 or a hard disk 118 is connected to the peripheral interface 108. Further, by connecting the digital camera 120 or a color scanner 122 to the peripheral interface 108, image processing is able to be performed on an image that is taken from the digital camera 120 or the color scanner 122. Furthermore, by installing a network interface card 110, the computer 100 is connected to a communication line 300 and data that is stored on a memory apparatus 310 that is connected to the communication line 300 is able to be obtained. Once the computer 100 obtains the image data that is to be printed, the printer 200 is controlled by the action of the printer driver 24 described above, and printing of the image data is performed.

Figure 5:
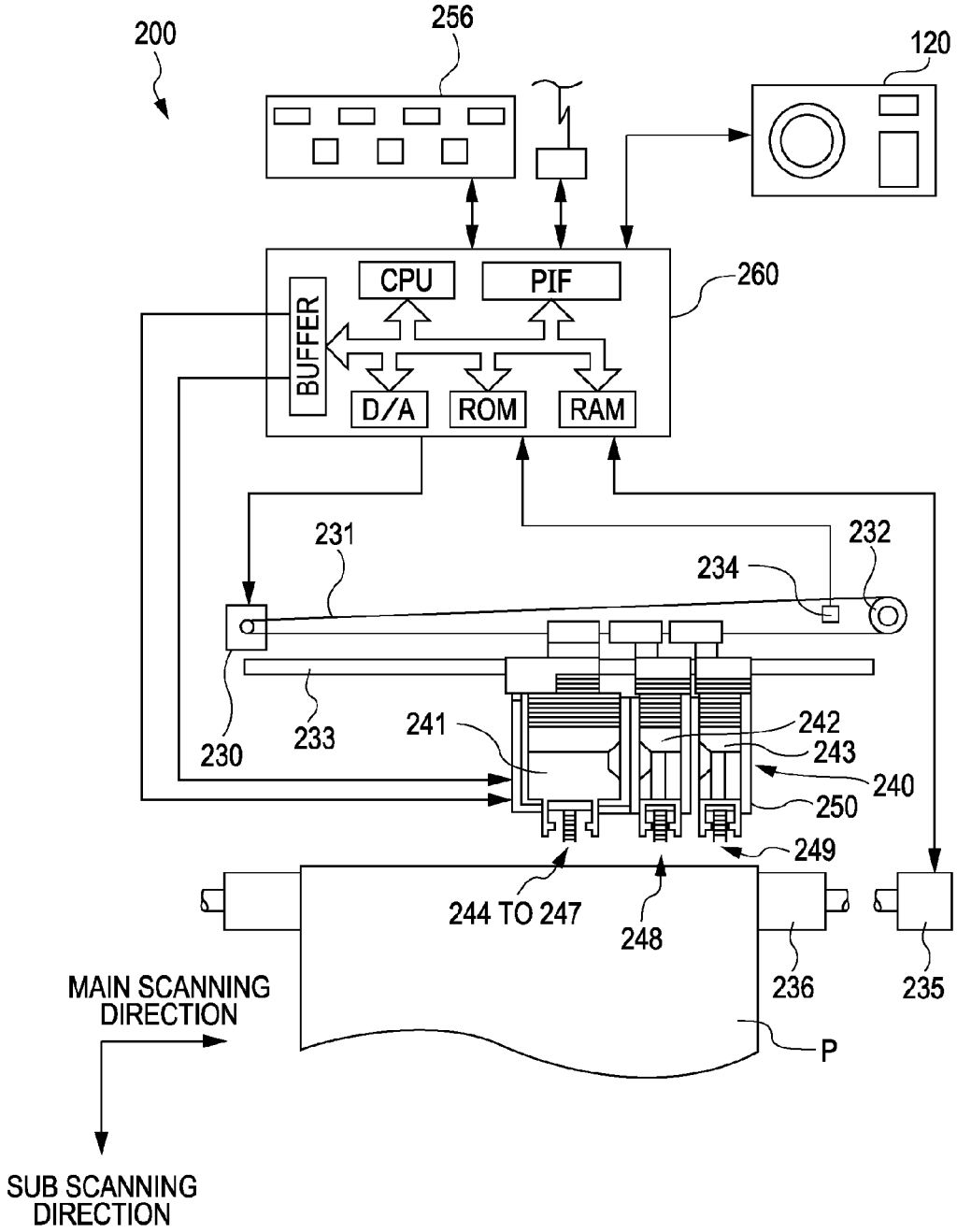
FIG. 5 is an explanatory diagram that describes a configuration of a printer.

Next, a configuration of the printer 200 will be described. FIG. 5 is a block diagram that illustrates a conceptual configuration of the printer 200. As illustrated in FIG. 5, the printer 200 is configured by a mechanism that transports a printing medium P by a paper feeding motor 235, a mechanism to cause a carriage 240 and a platen 236 to be reciprocated in the vertical axis by a carriage motor 230, a mechanism that discharges ink and performs dot formation by driving a print head 250 that is installed on the carriage 240, and a control circuit 260 that administers the exchange of signals between the paper feeding motor 235, the carriage motor 230, the print head 250, and an operation panel 256.

The mechanism that causes the carriage 240 and the platen 236 to reciprocate in the vertical direction is configured by a sliding shaft 233 that is installed to be parallel to the shaft of the platen 236 and which maintains the carriage 240 to be slidable, a pulley 232 that has an endless driving belt 231 stretched between the carriage motor 230 therewith, a position detection sensor 234 that detects the original position of the carriage 240, and the like.

Color ink cartridges 241 that accommodate each of cyan ink (C), magenta ink (M), yellow ink (Y), and black ink (K) as color ink are installed in the carriage 240. Further, a metallic ink cartridge 242 that accommodates metallic ink (S) and a white ink cartridge 243 that accommodates white ink (W) are also installed in the carriage 240. Six types of ink ejection heads 244 to 249 that correspond to each of the colors are formed in the print head 250 to the lower portion of the carriage 240. If the ink cartridges 241, 242, and 243 are equipped on the carriage 240 from above, the supply of ink from each cartridge to the ink ejection heads 244 to 249 becomes possible.

Figure 6A:
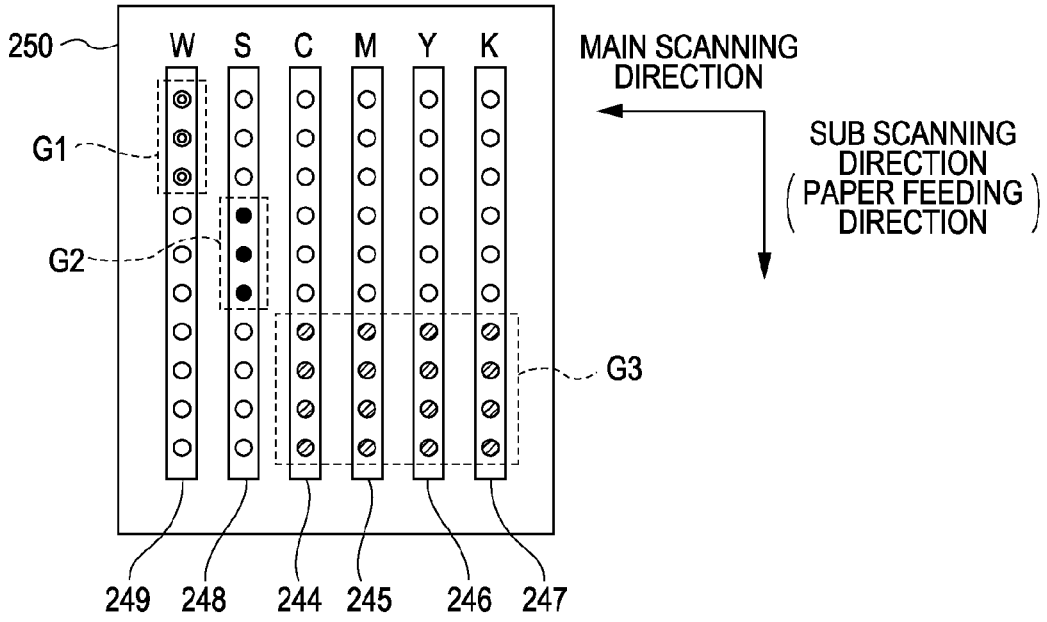
FIG. 6A is an explanatory diagram that describes a configuration of a print head.
Figure 6B:
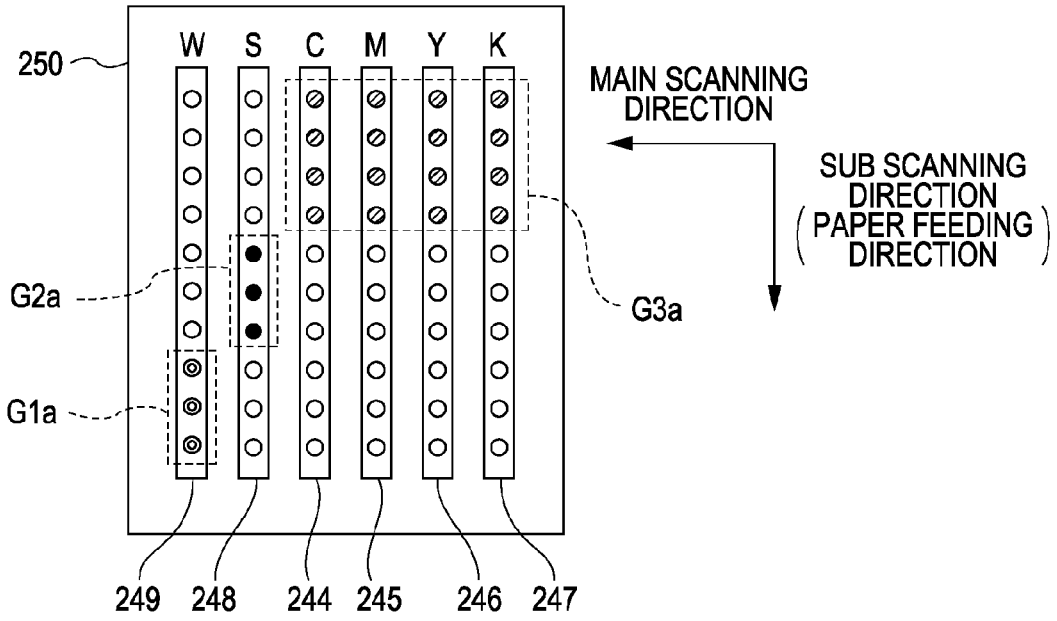
FIG. 6B is an explanatory diagram that describes another configuration of a print head.

Next, the print head 250 will be described. FIGS. 6A and 6B are explanatory diagrams that illustrate the nozzle arrangement of an ink ejection head that configures the print head 250 as an outline. Although 96 nozzles are respectively prepared for each color of white ink (W), metallic ink (S), cyan ink (C), magenta ink (M), yellow ink (Y), and black ink (K), in FIGS. 6A and 6B, for the convenience of illustration, there are 10 nozzles for each color. Hereinafter, although the number of nozzles for each color is described to be 10, the number of nozzles is determined by the specification of the printer 200. The nozzles that eject the ink of each color are arranged along a sub scanning direction on a lower surface of the print head 250. Each nozzle is arranged for every two raster rows, that is, with an interval of two dots in the sub scanning direction. In the drawing, since the bottom indicates the sub scanning direction (paper feeding direction), when printing, the printing locations of the printing medium P pass through from the nozzles at the very top downward.

In FIG. 6A, the nozzles that are used in the first printing mode and the third printing mode are shown as a white nozzle group G1, a metallic nozzle group G2, and a color nozzle group G3. In a case when printing is performed by the first or third printing mode, printing is performed on the printing medium P in the order of the white ink, the metallic ink, and the color ink. Therefore, in a case when printing is performed in the example by the first or third printing mode, as for the nozzles that are used in the print head 250, with regard to the nozzles that eject the white ink, the first to third nozzles from the sub scanning direction front side (white nozzle group G1) are used. With regard to the nozzles that eject the metallic ink, the fourth to sixth nozzles out of the ten from the sub scanning direction front side (metallic nozzle group G2) are used. With regard to the nozzles that eject the color ink (C, M, Y, and K), the seventh to tenth nozzles from the sub scanning direction front side (color nozzle group G3) are respectively used. By using the nozzles in such a manner, scanning the print head 250, and printing, printing by the first or third printing mode is able to be performed by applying the white ink on the printing medium P first, applying the metallic ink next, and applying the color ink last.

In FIG. 6B, the nozzles that are used in the second printing mode are shown as a white nozzle group G1', a metallic nozzle group G2', and a color nozzle group G3'. In a case when printing is performed by the second printing mode, printing is performed on the printing medium P in the order of the color ink, the metallic ink, and the white ink. Therefore, the positions of the nozzles that are used are different from the white nozzle group G1, the metallic nozzle group G2, and the color nozzle group G3 that are used in the case of the first or third printing mode. In a case when printing is performed in the example by the second printing mode, as for the nozzles that are used in the print head 250, with regard to the nozzles that eject the white ink, the eighth to tenth nozzles from the sub scanning direction front side (white nozzle group G1*a*) are used. With regard to the nozzles that eject the metallic ink, the fifth to seventh nozzles out of the ten from the sub scanning direction front side (metallic nozzle group G1*a*) are used. With regard to the nozzles that eject the color ink (C, M, Y, and K), the first to fourth nozzles from the sub scanning direction front side (color nozzle group G1*a*) are respectively used. By using the nozzles in such a manner, scanning the print head 250, and printing, printing by the second printing mode is able to be performed by applying the color ink on the printing medium P first, applying the metallic ink next, and applying the white ink last.

A piezo element is built into each nozzle illustrated in FIGS. 6A and 6B. As is widely known, the piezo element is an element that distorts a crystalline structure by applying a voltage and that performs conversion of electrical and mechanical energy at an extremely high speed. In the example, ink drops are caused to be ejected from the nozzles by transforming one side wall of the ink passage inside a nozzle by applying a voltage signal (driving signal) to predetermined piezo elements. Here, in the example, although the ink is caused to be ejected using piezo elements, a system in which the ink is caused to be ejected by causing bubbles to be produced within the nozzles may be adopted.

The control of the print head 250 described above is performed by the control circuit 260 of the printer 200 illustrated in FIG. 5. The control circuit 260 is configured with a CPU, a ROM, a RAM, a PIF (Peripheral Interface), and the like connected to one another by a bus, and performs control of the main scanning action and the sub scanning action of the carriage 240 by controlling the actions of the carriage motor 230 and the paper feeding motor 235. Further, if printing data that is output from the computer 100 is received via the PIF, the ejection of ink is controlled by supplying driving signals that correspond to the printing data to the ejection heads 244 to 249 when the carriage 240 moves away in the main scanning direction or returns in the main scanning direction, and printing for a predetermined raster is performed. If the moving away or returning that accompanies the ejection of ink is performed to the end of the main scanning direction of the printing medium P, the control circuit 260 transports the printing medium P in the sub scanning direction, and prepares for the printing of the next raster. By repeating such an operation, the printer 200 completes the printing by each of the first to third printing modes.

Here, although the printer 200 of the example is described as a so-called ink jet printer that forms dots by ejecting ink drops toward a printing medium P, a printer that applies ink on a printing medium by another method is also possible. For example, the printer 200 is able to be implemented, instead of ejecting ink drops, as a printer that applies ink by causing toner powders of each color to be adhered on a printing medium by using static electricity, a thermal transfer printer, or a sublimation printer.

A2. Printing Process

Figure 7:
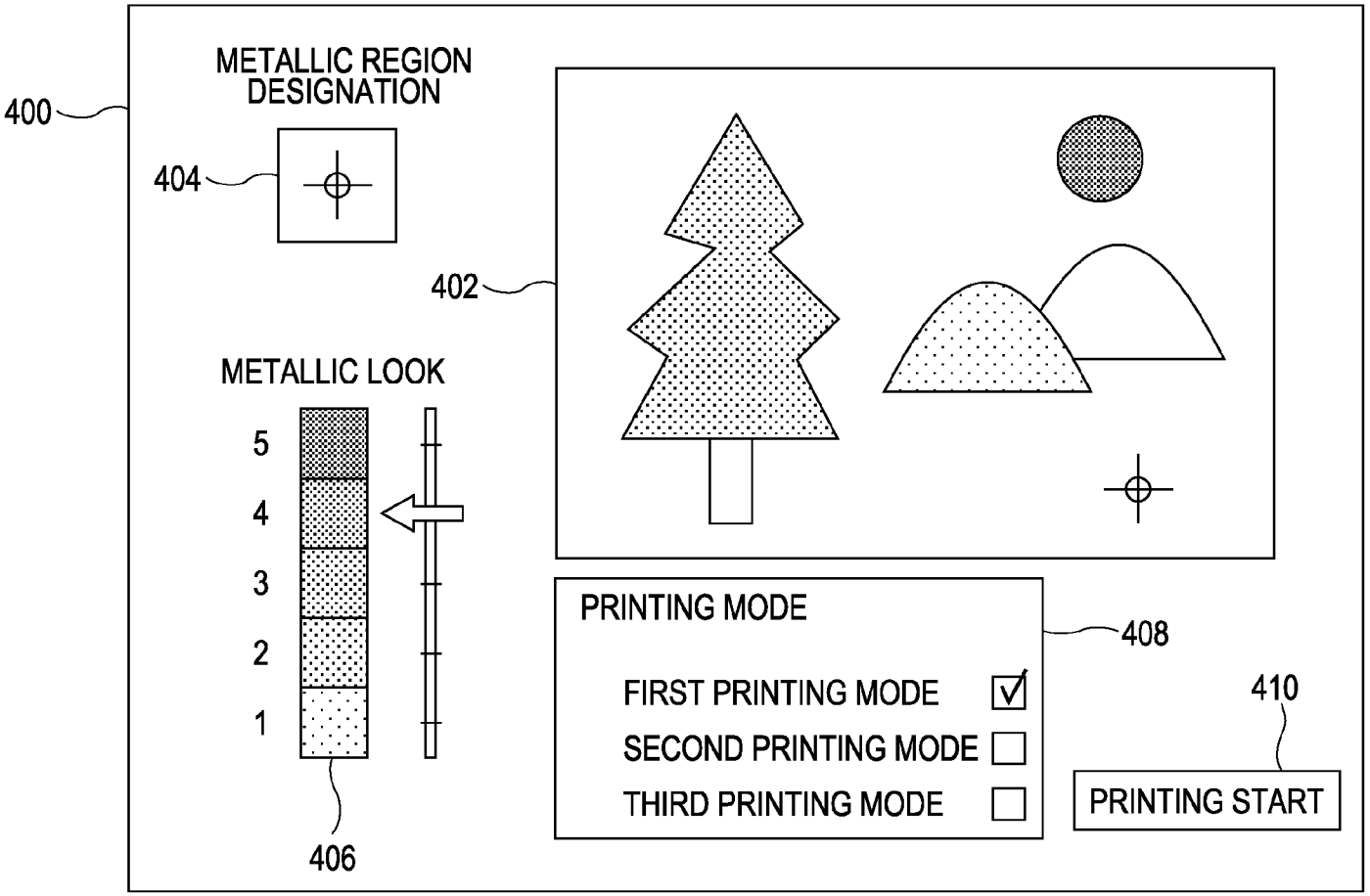
FIG. 7 is an explanatory diagram that illustrates a print setting screen.

Next, the printing process that the printing system 10 performs will be described. Ahead of the start of the printing process, the user performs print setting by using a print setting screen that the application program 20 displays on the display 114. The user performs designation from among the first to third print modes, designation of the metallic region in the image data ORG, and designation of the degree of the metallic look within the metallic region as the print settings. FIG. 7 is an explanatory diagram that illustrates a print setting screen 400 that the application program 20 displays on the display 114. The print setting screen 400 is composed of a print image display unit 402 that displays a printing image that corresponds to the image data ORG, a metallic region designation icon 404 that is an operation icon for the user to designate the metallic region on the printing image, a metallic look designation slider 406 for designating the degree of the metallic look of the metallic region, a printing mode selection unit 408 that selects from the first to third printing modes, and a printing start button 410 for the user to input an instruction to start printing after the print setting. The metallic look designation slider 406 is composed of a color patch that is divided into five levels of gradation of the metallic look. A metallic indicator value (1 to 5) that indicates the degree of the metallic look is attached next to the color patch of the metallic look shown on the metallic look designation slider 406. The smaller the metallic indicator value, the lower the tone of the metallic look, and the greater the metallic indicator value, the greater the tone of the metallic look.

On the print setting screen 400, after clicking the metallic region designation icon 404 for a printing image of the printing image display unit 402, the user designates the metallic region for a printing image that is being displayed on the printing image display unit 402 using a mouse that is a pointing device. Further, the metallic look is designated as a metallic indicator value on each designated metallic region using the metallic look designation slider 406. After designating the metallic look, the printing mode is determined by the printing mode selection unit 408, the application program 20 generates image data in a format (hereinafter, RGBS format) in which information relating to the metallic region (metallic region and metallic indicator value) is added to image data of an RGB format by operating the printing start button 410, and the printing process of the printing system 10 is started.

Figure 8:
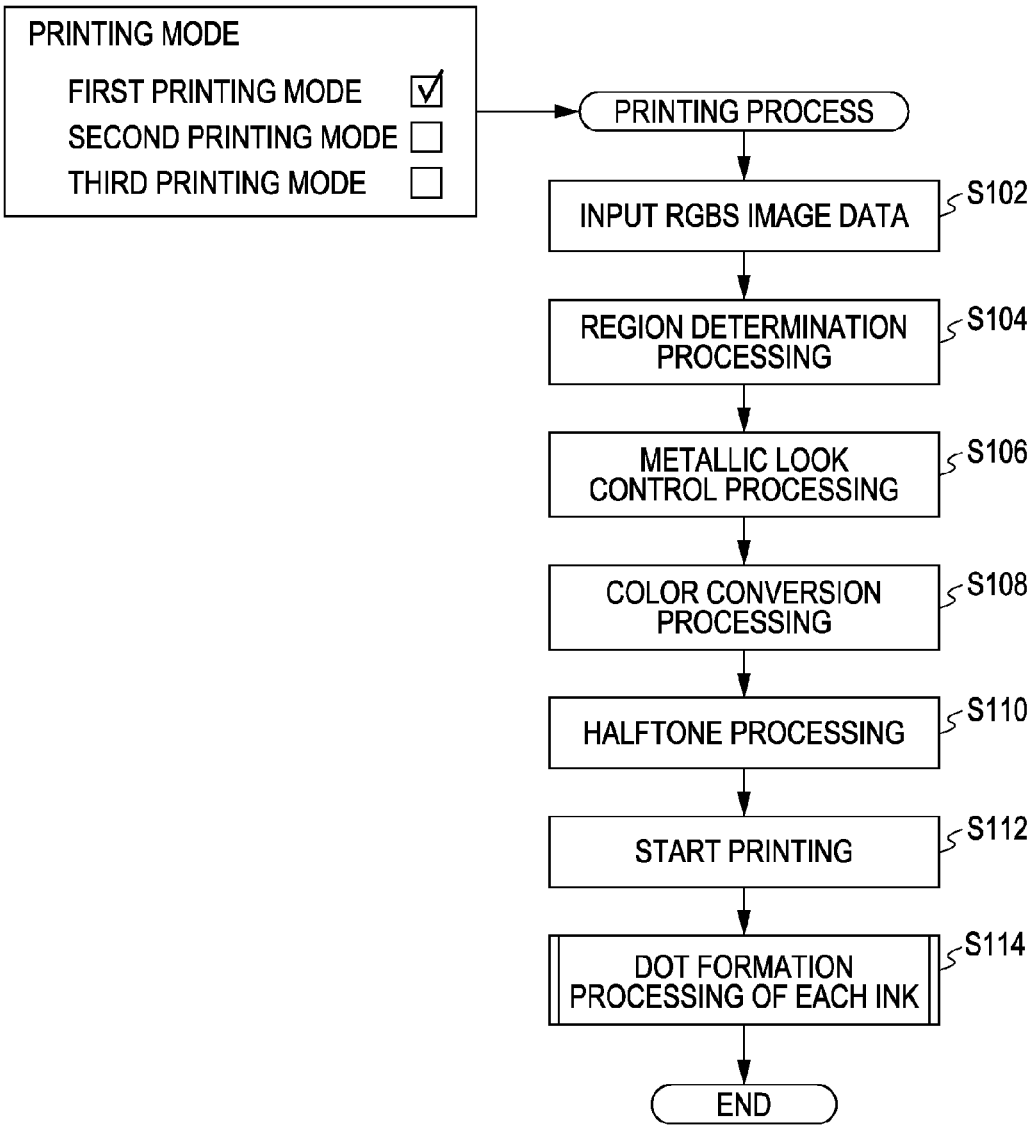
FIG. 8 is a flowchart that illustrates the flow of printing processes.

FIG. 8 is a flowchart that illustrates the flow of printing processes that the printing system 10 performs. When the printing process is started, the computer 100 inputs image data of an RGBS format (step S102). Once the image data is input, the computer 100 distinguishes the metallic region that is designated by the application program 20 (step S104). Next, a metallic look control process of determining the ink duty WD of the white ink that is applied on a white region that overlaps each metallic region based on data of the metallic indicator value that is added to each metallic region is performed (step S106).

Figure 9A:
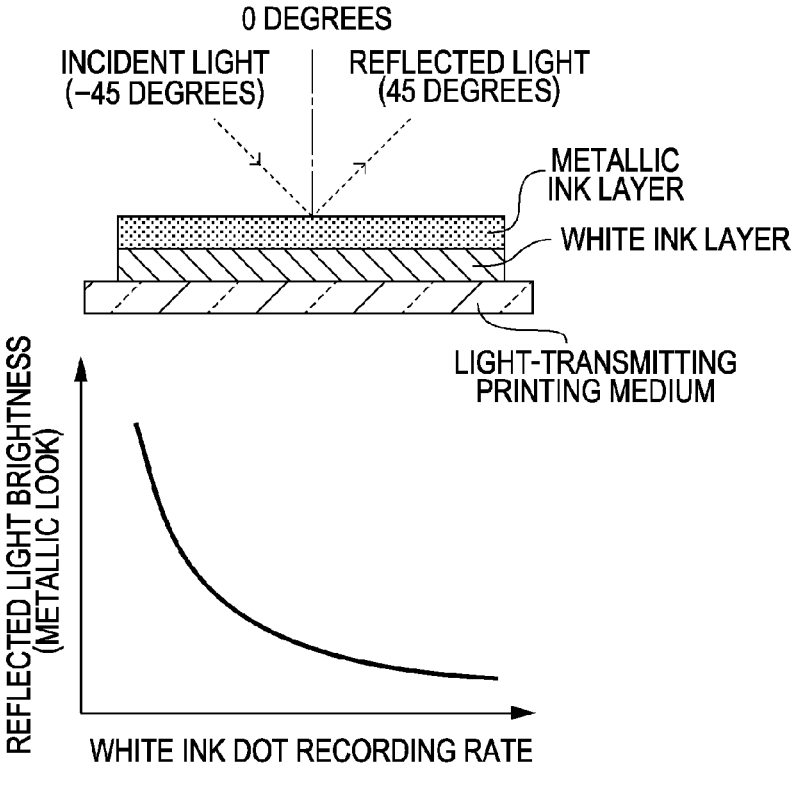
FIG. 9A is an explanatory diagram that describes a change in the metallic look against a change in the ink amount of white ink.
Figure 9B:
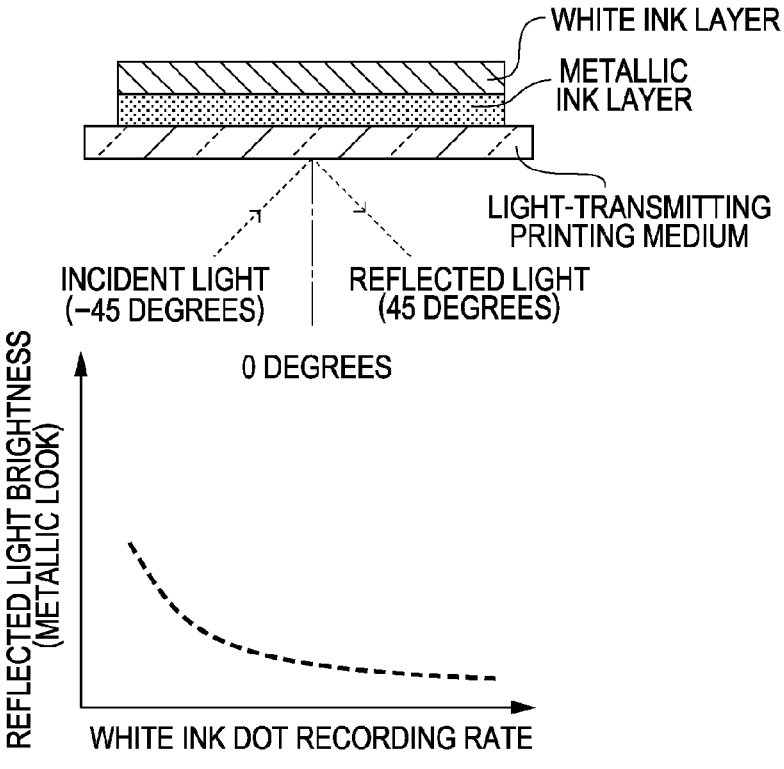
FIG. 9B is another explanatory diagram that describes a change in the metallic look against a change in the ink amount of white ink.

Here, the metallic look control process will be described. The metallic look control process in the example is a process of controlling the degree of the metallic look of the metallic region within a print image by controlling the ink amount of the white ink that is added to the white region that overlaps the metallic region. In the example, control of the ink amount is performed by defining the ink amount of the white ink that is added as the dot recording rate (ink duty WD) of the white ink. FIGS. 9A and 9B are explanatory diagrams that illustrate the change in the metallic look in a case when the recording rate of metallic dots that are added to the metallic region is fixed and the dot recording rate of the white ink that is added to the white region that overlaps the metallic region is changed. The metallic ink and the white ink are added in that order to a light-transmissive printing medium from the nearest side from the observation point, and the brightness of the reflected light that is regularly reflected from a surface on which the metallic ink is added is defined as the "metallic look". The brightness of regularly reflected light indicates the brightness of the reflected light from an observation point of an angle of 45° in a case when a measurement target is irradiated with incident light from an angle of −45°.

FIG. 9A illustrates the change in the metallic look in a print image in which the white ink and the metallic ink are added in that order to a light-transmissive printing medium in a case when the ink duty WD of the white ink is caused to change. Here, the dot recording rate of the metallic ink that is added is fixed. As can be seen from FIG. 9A, as the ink duty WD increases, the metallic look is toned down.

FIG. 9B illustrates the change in the metallic look in a print image in which the metallic ink and the white ink are added in that order to a light-transmissive printing medium in a case when the ink duty WD of the white ink is caused to change. Here, the dot recording rate of the metallic ink that is added is fixed. As can be seen from FIG. 9B, as the ink duty WD increases, similarly to FIG. 9A, the metallic look is toned down. Further, the curve illustrated in FIG. 9A which indicates the change in the metallic look has a greater rate of change with respect to the change in the ink duty WD of the white ink than the curve illustrated in FIG. 9B which indicates the change in the metallic look.

The white ink amount table LUT 2 (refer to FIG. 1) that is included in the printer driver 24 of the computer 100 stores the relationship between the white ink and the metallic look that is illustrated in FIGS. 9A and 9B as a lookup table (hereinafter also referred to simply as an LUT). Specifically, the white ink amount table LUT 2*a* that is used in the first and third printing modes has the relationship between the ink duty WD and the metallic look illustrated in FIG. 9A recorded thereon. The white ink amount table LUT 2*b* that is used in the second printing mode has the relationship between the ink duty WD and the metallic look illustrated in FIG. 9B recorded thereon.

In the metallic look control process (FIG. 8: step S106), the white ink amount table LUT 2 is referenced based on the metallic indicator value that is added to the input image data, and the ink duty WD of the white ink that is added to the metallic region is determined. Here, as described above, the ink duty WD of the white ink that is added to a non-metallic region is set in advance in the halftone module 44 as a fixed value.

When the metallic look control process ends, next, the computer 100 starts the color conversion process using the color conversion module 42 (step S108). Specifically, the RGB components of the input RGBS format data are converted into image data of a CMYK format. Once the image data of the CMYK format is obtained, the computer 100 generates data that is transportable to the printer 200 using the halftone module 44 (step S110). In the halftone processing, a binarization process is performed not only on the color ink but also on the metallic ink (S) and the white ink (W). Halftone processing is performed such that the dot recording rate becomes uniformly 30% over the metallic region. Although the lustrous look of the metallic ink (S) increases in accordance with the ink amount (recording rate) up to approximately 30%, there is hardly any increase in the lustrous look beyond 30%. Therefore, in the example, the halftone processing is performed such that the dot recording rate of the metallic ink becomes 30%.

With regard to the white ink, in the region that overlaps the non-metallic region out of the white region, the halftone processing is performed such that the dot recording rate becomes uniformly 80%. On the other hand, with regard to the white region that overlaps the metallic region, the metallic look is controlled by performing the halftone processing in accordance with the dot recording rate of the white ink which is determined by the metallic look control process.

Once the halftone processing is ended, the computer 100 controls the printer 200 using the printing control module 45 and starts printing (FIG. 8: step S112). Once the printing is started, the printer 200 performs the process of forming the dots of each ink (step S114). The process of forming the dots of each ink is performed as below across the entire range in which an image is formed on the printing medium P.

First and Third Printing Modes

In the first and third printing modes, only the printing media differ and the contents of the printing process are the same. Both are printing modes for observing the print image from the printing surface. The printing medium is light-transmissive in the printing process of the first printing mode, and the printing medium is non-light-transmissive in the printing process of the third printing mode. In a case when the first or third printing mode is set by the printing mode setting unit 49 when the printing process is started, the dots of each ink are formed as below.

If the first or third printing mode is designated, the discharge of each ink is performed by the control circuit 260 controlling each ink discharge head 244 to 249 to match the reciprocating movement of the carriage. In terms of one raster, 1) the white ink that is discharged from the white nozzle group G1 is applied first on the printing medium P, 2) the metallic ink that is discharged from the metallic nozzle group G2 is applied next on the printing medium, and 3) the color ink that is discharged from the color nozzle group G3 is applied last. As a result, a white ink layer is first formed by applying the white ink on the printing medium P, a metallic ink layer is formed by applying the metallic ink (S) thereon, and a color ink layer is further formed by applying the color ink (C, M, Y, and K) of each color thereon.

Second Printing Mode

The second printing mode is a printing mode for observing the print image from the opposite side to the printing surface. In the printing process of the second printing mode, the printing medium is light-transmissive. In a case when the second printing mode is set by the printing mode setting unit 49 when the printing process is started, the dots of each ink are formed as below.

If the second printing mode is designated, the discharge of each ink is performed by the control circuit 260 controlling each ink discharge head 244 to 249 to match the reciprocating movement of the carriage. In terms of one raster, 1) the color ink that is discharged from the color nozzle group G1*a* is applied first on the printing medium P, 2) the metallic ink that is discharged from the metallic nozzle group G1*a* is applied next on the printing medium P, and 3) the white ink that is discharged from the white nozzle group G1*a* is applied last. As a result, a color ink layer is formed first by applying the color ink (C, M, Y, and K) on the printing medium P, a metallic ink layer is formed by applying the metallic ink (S) thereon, and a white ink layer is further formed by applying the white ink (W) thereon.

As described above, in the printing process of the example, the control of the metallic look of the print image is performed by controlling the ink duty WD that is the dot recording rate of the white ink. In a case when the control of the metallic look is controlled by the dot recording rate of the metallic ink, if the metallic look is toned down, the granularity of the metallic ink may stand out to an extent that is observable. In comparison, in the example in which the metallic look is controlled by fixing the dot recording rate of the metallic ink (30% in the example) and controlling the ink duty WD of the white ink that is applied on the metallic layer, it is possible to increase or decrease the metallic look while applying enough metallic ink such that the granularity does not stand out.

In addition, in a case when the printing medium is light-transmissive (first or second printing mode), although the ink duty WD of the white ink increases and decreases, since the dot recording rate of the metallic ink is kept constant, it is possible to lower the metallic look while securing the opacity of the metallic ink. Further, in a case when the ink amount of the metallic ink is small, although there is a case when the attachability of the metallic ink to the printing medium decreases, in the example, since the dot recording rate of the metallic ink is able to be fixed, such a problem is able to be avoided.

In a case when the printing medium is light-transmissive, although the characteristic of the increase or decrease of the metallic look from the increase or decrease in the ink duty WD of the white ink is different between a printing mode that is used in a case when the printing medium is observed from the printing surface (first printing mode) and a printing mode that is used in a case when the printing medium is observed from the opposite side to the printing surface (second printing mode), since the printing system 10 of the example includes the white ink amount table LUT 2*a* and the white ink amount table LUT 2*b* that correspond to the characteristics of each case, it is possible to express the desired metallic look that the user designates with high precision using either printing mode.

B. Modification Examples

Here, aspects of the invention are not limited to the examples or the embodiments described above and are able to be implemented by various forms within a range without departing from the gist thereof, and, for example, the following modifications are possible.

B1. Modification Example 1

Figure 10:
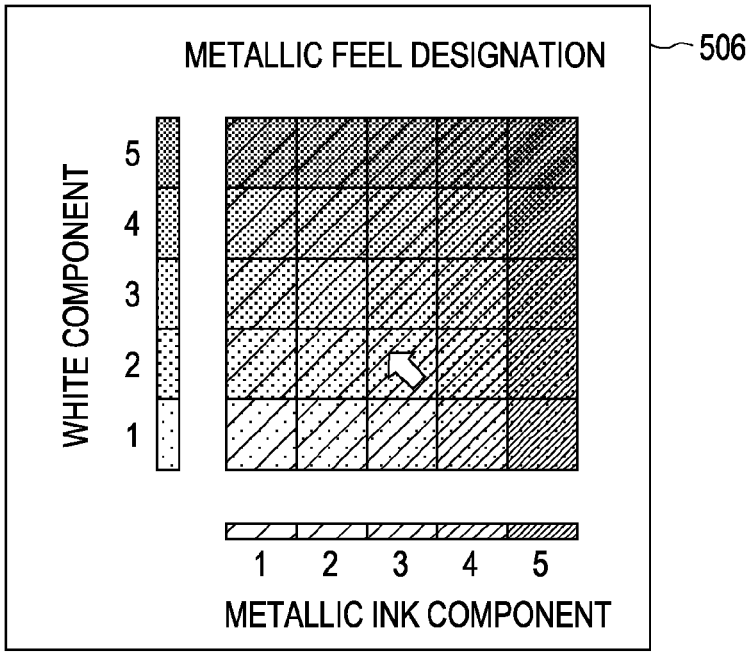
FIG. 10 is an explanatory diagram that describes Modified Example 1.

Although the metallic look of a print image is controlled by controlling the ink amount (dot recording rate in the example) of the white ink as the light-blocking ink that is applied on the white region that overlaps the metallic region, the metallic look may be controlled by also controlling the ink amount of the metallic ink that is applied on the metallic region. Since the feel of the metallic look that the user sees is different between a case when the ink amount of the white ink is controlled and a case when the ink amount of the metallic ink is controlled, by combining the increase or decrease in the ink amount of the white ink and the increase or decrease in the ink amount of the metallic ink, a wide range of feel of the metallic ink becomes possible to be expressed. For example, the dot recording rates of the white ink and the metallic may be determined according to the metallic look that the user designates by the metallic look designation unit 506 by displaying the metallic look designation unit 506 composed of a color patch that indicates the metallic look as illustrated in FIG. 10 instead of the metallic designation slider 406 that is displayed on the print setting screen 400 which is described in FIG. 7. In such a case, the white ink amount table LUT 2 that is used when determining the ink amount of the white ink is able to be used as is. Therefore, the modification example is able to be implemented by further including a lookup table that is made to correspond with the metallic look of the metallic look designation unit 506 and the dot recording rate of the metallic ink in addition to the configuration of the example described above. In so doing, in addition to the effects in the applied examples described above, printing in which expression of the feel of the metallic look is further expanded as compared to the applied examples described above is able to be performed.

B2. Modification Example 2

Figure 11:
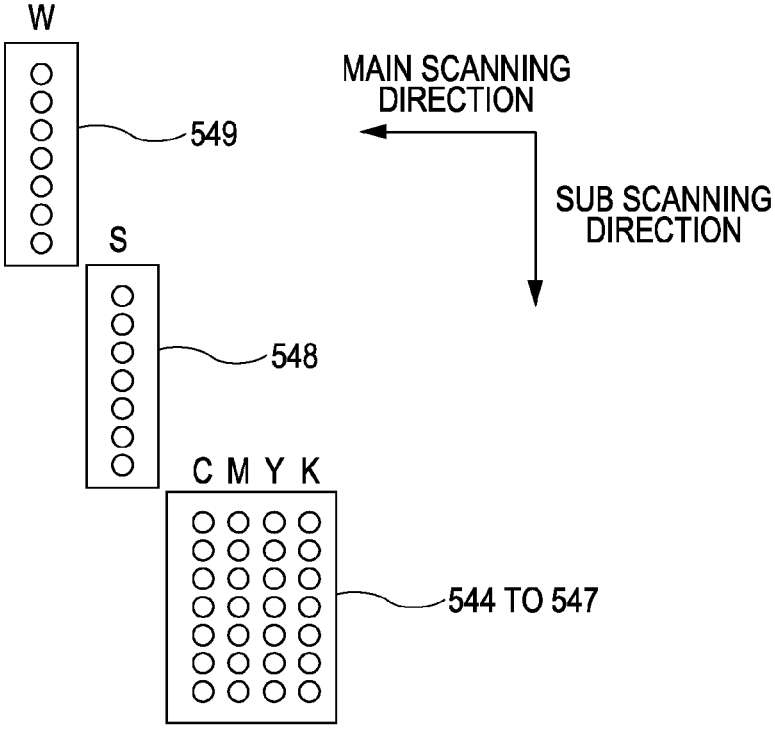
FIG. 11 is an explanatory diagram that describes Modified Example 2.

Although the print head 250 of a configuration as described in FIGS. 6A and 6B has been adopted in the example described above, without being limited thereto, a print head of a different configuration may be adopted. For example, as illustrated in FIG. 11, a print head of a configuration in which the discharge heads 544 to 549 of each ink are shifted in the sub scanning direction from the start may be adopted. The same effects as those in the example described above are also able to be obtained in such a manner.

B3. Modification Example 3

Although an ink jet printer is used in the example described above, without being limited thereto, a line printer is also able to be used. In the case of a line printer, by arranging the ink nozzles in a direction that is perpendicular to the main scanning direction in the order of the white ink, the metallic ink, and the color ink from the front side against the main scanning direction of the printing medium, the same printing process as in the first and third printing modes of the example described above is able to be performed. Further, by arranging the ink nozzles in a direction that is perpendicular to the main scanning direction in the order of the color ink, the metallic ink, and the white ink from the front side against the main scanning direction of the printing medium, the same printing process as in the second printing mode in the example described above is able to be performed.

B4. Modification Example 4

Although the printing system 10 applies the color ink on the printing medium by including the color ink cartridge 241 in the example described above, without being limited thereto, a printing process in which only the white ink and the metallic ink are applied on the printing medium may be performed without including a color ink cartridge. Control of the metallic look of the print image is also possible in such a case. In addition, a single color ink or color ink of the three colors of C, M, and Y or more may be able to be applied, or only the black ink may be able to be applied as the color ink. Further, other than the white ink, pearlescent white with pearlescent luster may be used as the light-blocking ink, or light-blocking inks of two colors or more may be used.

What is claimed is:

1. A printer comprising:

a print head that ejects at least white ink and metallic ink, a control circuit that controls the print head to ejects the white ink to white region set as printing medium, and to ejects the metallic ink to metallic region set as the printing medium; wherein, the control circuit controls to change dot recording rate of the white ink per unit area, according to designated metallic indicator value.

2. The printer according to claim 1, wherein, the control circuit controls to decrease the dot recording rate of the white ink per unit area, when the metallic indicator value is made to increase.

3. The printer according to claim 1, wherein, the control circuit controls to increase the dot recording rate of the white ink per unit area, when the metallic indicator value is made to decrease.

4. The printer according to claim 1, wherein, in region with which the white region and the metallic region overlap, the control circuit controls to change the dot recording rate of the white ink per unit area, according to designated metallic indicator value, in region with which the white region and the metallic region do not overlap, the control circuit controls the dot recording rate of the white ink per unit area uniformly.

5. The printer according to claim 1, wherein, the metallic indicator value is designated by application program.

6. The printer according to claim 1, wherein, the print head further ejects color ink, the control circuit controls the print head to ejects the color ink to color region set as the printing medium, and to overlap a part of the white region and a part of the metallic region overlap at least, and to overlap a part of the metallic region and a part of the color region overlap at least.

7. A printing method comprising:

ejecting white ink to white region set as printing medium, and metallic ink to metallic region set as the printing medium, wherein, changing dot recording rate of the white ink per unit area, according to designated metallic indicator value.

8. A non-transitory computer readable storage medium recording a computer-readable program that prompts a computer to execute functions of:

ejecting white ink to white region set as printing medium, and metallic ink to metallic region set as the printing medium, wherein, changing dot recording rate of the white ink per unit area, according to designated metallic indicator value.

* * * * *